United States Patent [19]

Shigyo

[11] Patent Number: 4,995,445

[45] Date of Patent: Feb. 26, 1991

[54] GAS VENT SYSTEM OF A MOLD

[75] Inventor: Masatomo Shigyo, Hiroshima, Japan

[73] Assignee: Mazda Motor Corporation, Hiroshima, Japan

[21] Appl. No.: 481,368

[22] Filed: Feb. 20, 1990

[30] Foreign Application Priority Data

Feb. 20, 1989 [JP] Japan ..... 64-39560

[51] Int. Cl.[5] ..... B22D 17/20

[52] U.S. Cl. ..... 164/305; 164/410; 425/420; 425/812

[58] Field of Search ..... 164/305, 410; 425/420, 425/812

[56] References Cited

FOREIGN PATENT DOCUMENTS 59-37147 9/1984 Japan ..... 164/305

62-104659 5/1987 Japan ..... 164/305

*Primary Examiner*—Kuang Y. Lin

*Attorney, Agent, or Firm*—Fish & Richardson

[57] ABSTRACT

A gas vent system of a mold improves timing of closing the gas vent passageway, in particular in die castings or in moldings. The gas vent passageway is formed on mating surfaces of a pair of mold halves and communicating a mold cavity with the outside of a mold when the mold is closed. The gas vent valve is mounted on one of the mold halves and disposed intersecting perpendicularly to the gas vent passageway and is provided with a concave portion on its end surface receiving the pressure from the molten pressure charged. The other mold half is provided with a projection which can be fitted tightly in the concave portion of the gas vent valve, and the projection is provided with part of the gas vent passageway so as to direct a flow of the molten material passed through the gas vent passageway from the mold cavity toward the concave portion of the gas vent valve. The gas vent valve is operated to close the gas vent passageway in response to a pressure from the molten material forced into the mold cavity.

17 Claims, 4 Drawing Sheets

GAS VENT SYSTEM OF A MOLD

BACKGROUND OF THE INVENTION

1. Field of the Invention

The present invention relates to a gas vent system of a mold.

2. Description of Related Art

A molding machine is generally provided with a gas vent unit in order to prevent failures or defects such as gas holes, shrinkage voids or the like in molding or casting. For instance, die castings are made by forcing molten metal under high pressure into a metal mold, so that they can provide die castings with fine metal textures, good die-cast surface smoothnesses, and close dimensional tolerances. In the die castings, the molten material is forced under high pressure into a mold cavity of the mold so that any gases in the cavity should be allowed to escape toward the outside.

The gas vent unit equipped in the mold usually comprises a gas vent passageway defined between mating surfaces of the mold halves and communicated with the outside of the mold from the mold cavity, when the mold halves are closed, and a gas vent valve mounted on one of the halves.

Japanese Patent Examined Publication (kokoku) No. 14,229/1984 discloses a gas vent system of conventional type, in which a gas vent valve is disposed in a position perpendicular to a gas vent passageway and the vale is designed to be closed to shut off the gas vent passageway from the outside only when the passageway is filled with the molten material forced into the mold cavity. In other words, the gas vent valve starts operating to close the gas vent passageway when the molten material forced into the cavity then fills the gas vent passageway extending from the cavity to the gas vent valve.

This is not preferred, however, in terms of sensitivity of the gas vent valve. In the initial stage when the molten material is extended to the gas vent valve, a small amount of gases held in the gas vent passageway is still being discharged toward the outside. Accordingly, it is preferred that the gas vent valve starts operating to close the gas vent passageway from the initial stage when the molten material has reached the gas vent valve.

The gas vent unit of such conventional type as described hereinabove is further designed to allow a whole surface area of its end face of the gas vent valve, which faces the gas vent passageway, to receive the pressure of the molten material. This requires the gas vent passageway to pass through a whole length of a peripheral portion of the facing end face of the gas vent valve, thereby incurring the risk that the molten material is leaked from a portion where the gas vent valve is mated with the mold have to which the valve is mounted.

SUMMARY OF THE INVENTION

Therefore, the present invention has the object to provide a gas vent system of a mold adapted to improve the timing when the gas vent valve is closed.

In order to achieve the object, the present invention consists of a gas vent system of a mold, comprising:

a gas vent passageway formed on mating surfaces of a pair of mold halves and communicating a mold cavity with the outside of a mold when the mold is closed; and a gas vent valve mounted on one of the mold halves and disposed intersecting in a direction substantially perpendicular to the gas vent passageway so as to block the gas vent passageway in response to a pressure from a molten material forced into the mold cavity;

wherein the gas vent valve is provided on its end surface receiving the pressure from the molten material with a concave portion opening toward the other of the mold halves;

a projection is formed on the other of the mold halves and disposed so as to be fitted tightly in the concave portion of the gas vent valve when the mold is fastened; and the projection is provided with part of the gas vent passageway, which is directed toward the concave portion of the gas vent valve so as to pass gases therethrough from the mold cavity to the concave portion of the gas vent valve.

In the arrangement as described hereinabove, the gas vent passageway is curved so as to be directed toward the gas vent valve in the position of the projected area where part of the gas vent passageway is disposed, so that the molten material is brought into direct collision with the concave portion on the end face of the valve section of the gas vent valve, the face being to receive a pressure from the molten material, and the flow of the molten material acts upon the gas vent valve itself so as to close the gas vent passageway. This arrangement serves as improving sensitivity of the gas vent valve and consequently accuracy in timing of closing the valve.

As the concave portion is formed on the end face of the valve section of the gas vent valve mounted on the mold halve, the other mold half is provided with the projection so as to be fitted tightly in the concave portion and the projection is provided with the passage section through which the molten material flows toward the concave portion of the gas vent valve. This arrangement can significantly reduce a portion where the peripheral portion of the end face of the gas vent valve is exposed to the gas vent passageway, thereby preventing the molten material from leading toward the outside from the mating surface between the gas vent valve and the mold half to which the valve is mounted.

Other objects, features and advantages of the present invention will become apparent in the course of the description of the preferred embodiments which follows, with reference to the accompanying drawings.

DESCRIPTION OF THE PREFERRED EMBODIMENT

The present invention will be described by way of examples with reference to the accompanying drawings.

Figure 1:
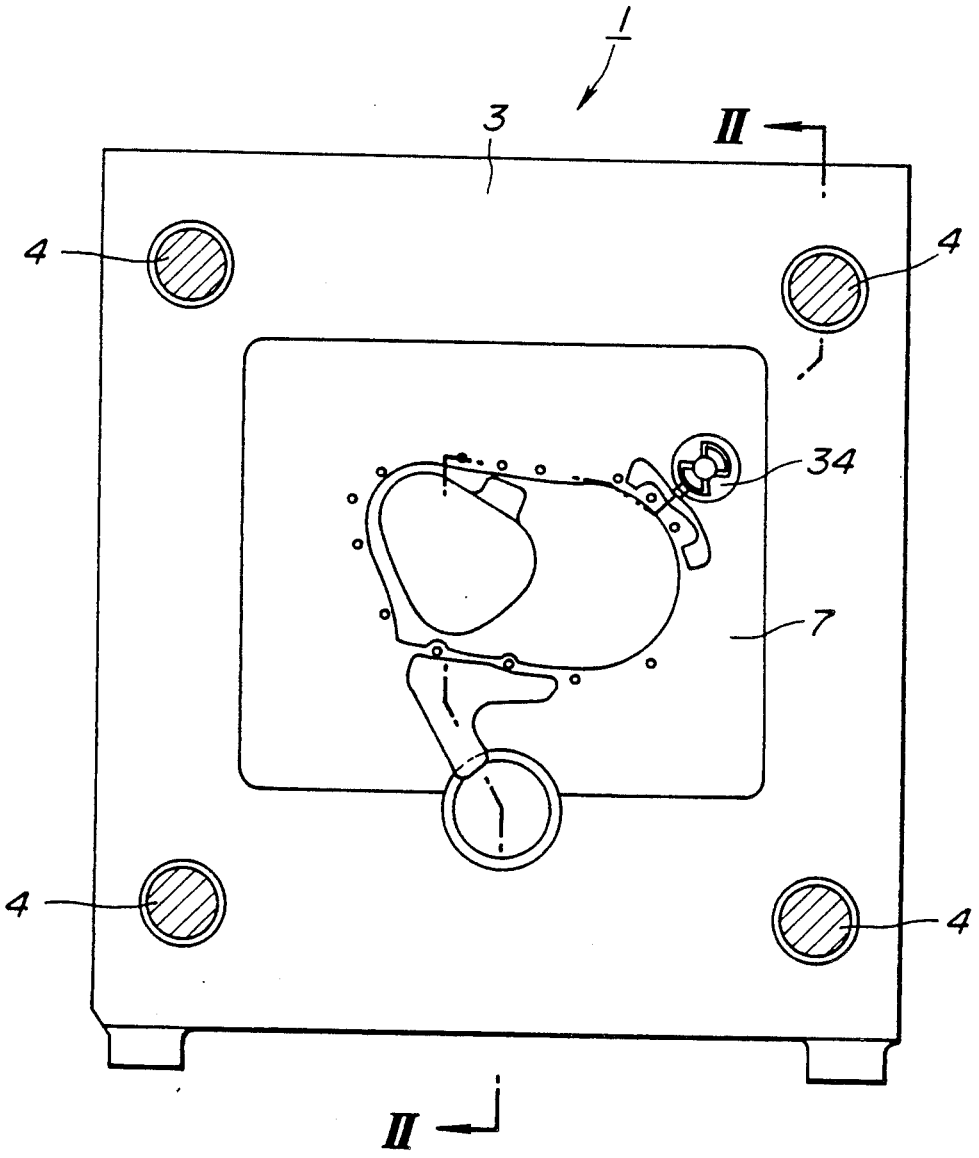
FIG. 1 is a plan view showing a fixed mold half according to one example of the present invention.
Figure 2:
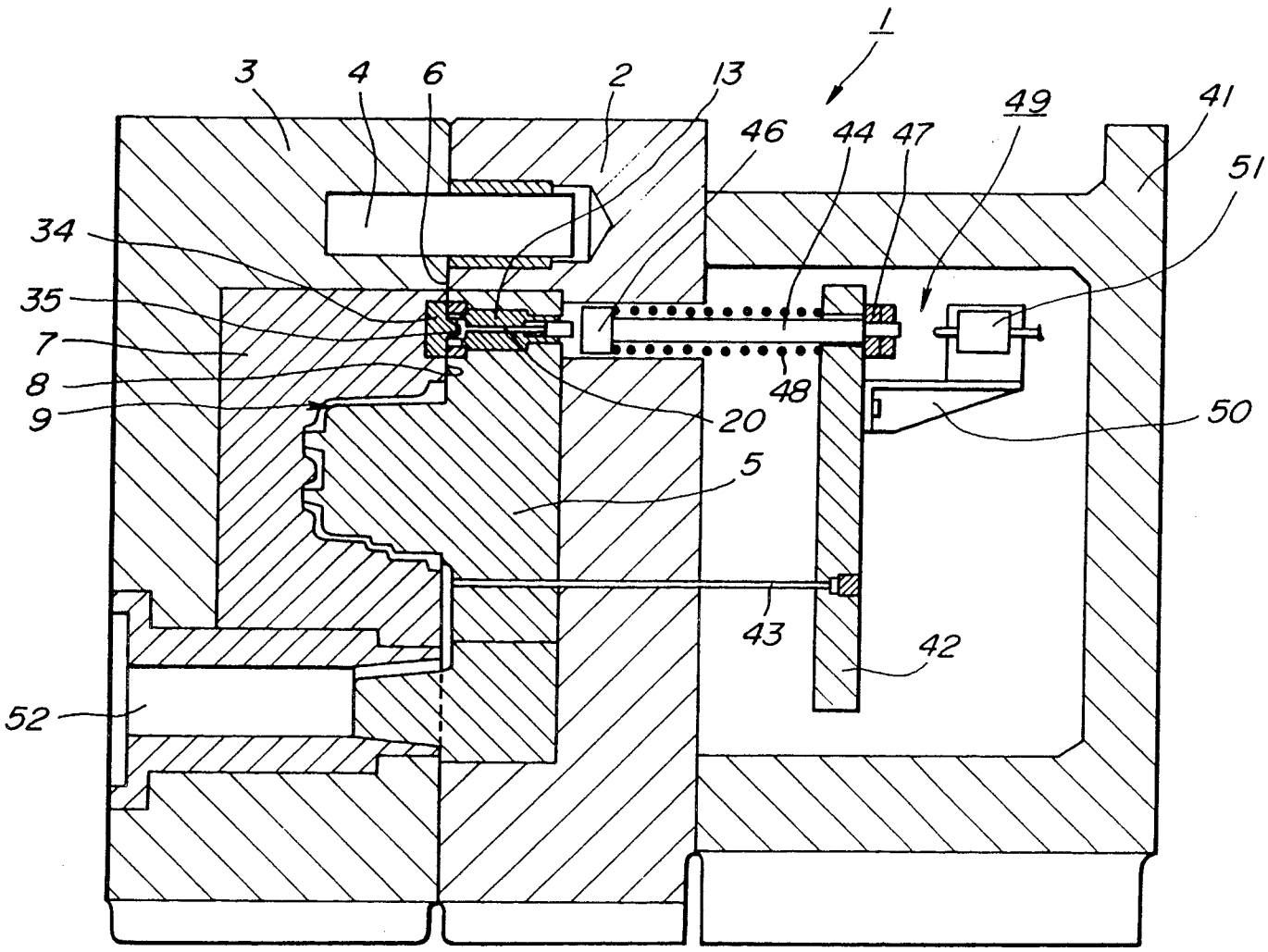
FIG. 2 is a sectional view taken along line II—II of FIG. 1.
Figure 3:
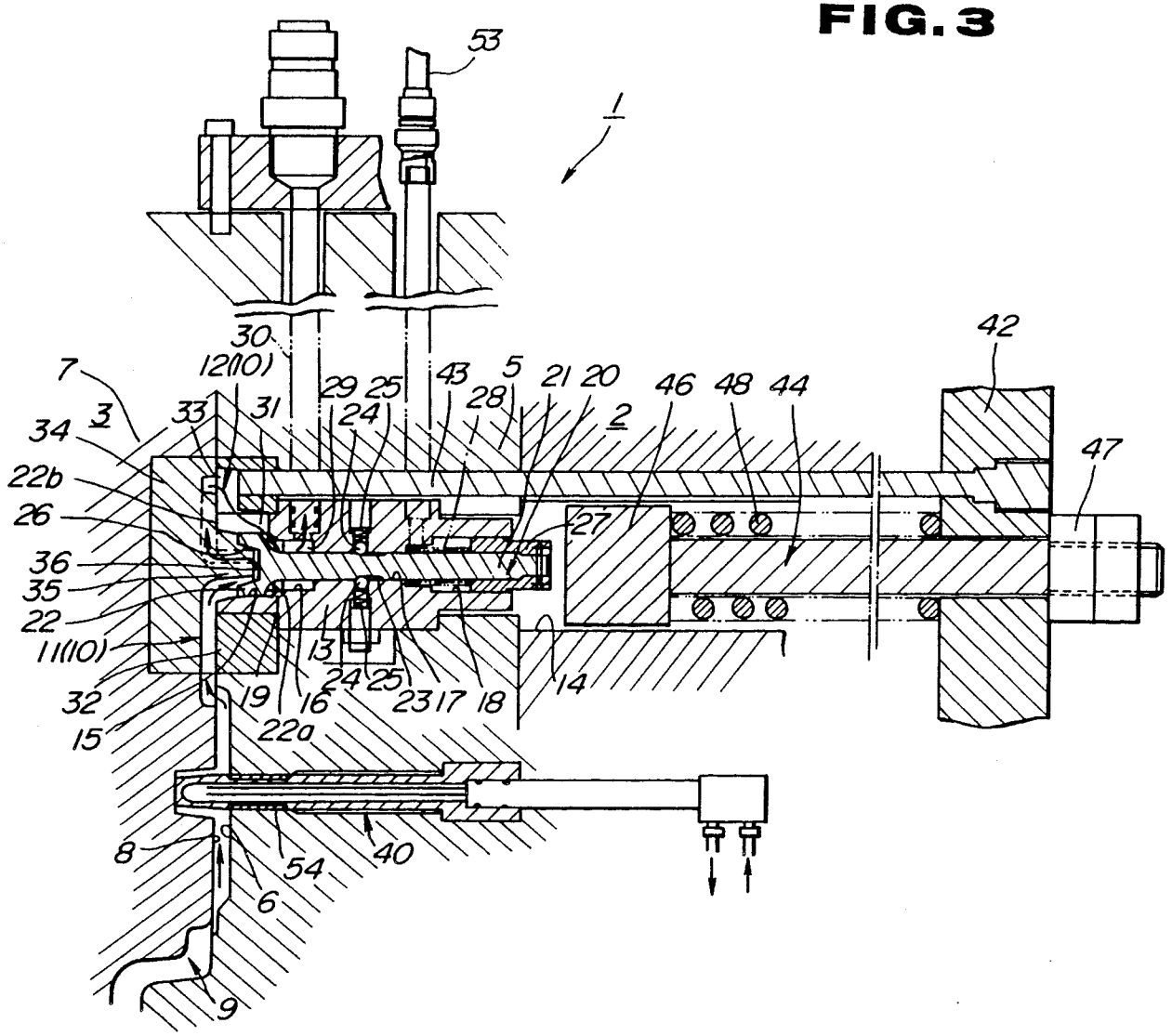
FIG. 3 is a sectional view with its essential portion enlarged, according to one example of the present invention.

As shown in FIGS. 1 to 5, reference numeral 1 denotes a molding unit to be used for die casting. As shown specifically in FIG. 2, the molding unit 1 comprises a movable mold half 2 and a fixed mold half 3. The movable mold half 2 is arranged so as to close or open the fixed mold half 3—in other words, to approach to or depart from it—by means of a plurality of guide rods 4. A first insert 5 is mounted in the movable mold half 2, on the one hand, and an end surface of the first insert 5 comprises a portion of a mating face 6 of the movable mold half 2. A second insert 7 is mounted in the fixed mold half 3, on the other hand, and an end surface of the second insert 6 comprises part of a mating face 8 of the fixed mold half 3. When the movable mold half 2 is fastened to the fixed mold half 3, the first insert 5 forms a mold cavity 9 and a gas vent passage 10 in association with the second insert 7, the passage being arranged so as to communicate the mold cavity 9 with the outside. In this embodiment, the mold cavity 9 is arranged in such a form as corresponding to the shape of a molding, for example, to the transmission case of a transmission, to be loaded on a vehicle as an automobile. The gas vent passage 10 comprises a first passage section 11 formed between the mating faces 6 and 8 and a second passage section 12 disposed so as to communicate the first passage section 11 with the outside, as shown in FIG. 3. The second passage section 12 is formed on the movable mold half 2.

As shown in FIGS. 2 and 3, a valve guide 13 in a cylindrical form is inserted so as to fit in the first insert 5. A top side face of the valve guide 13 (a left-hand side face in FIG. 3) constitutes part of the mating face 6 while a rear end of the valve guide (a right-hand side face in FIG. 3) faces an aperture 14 formed in the movable mold half 2. The valve guide 13 is provided with a terraced hole which comprises a larger-diameter hole section 15 disposed in its position closer to the mating face 6 (on the side of the end face of the valve guide 13), a middle-diameter hole section 16 disposed in its middle portion, a smaller-diameter hole section 17 disposed closer to the aperture 14, and an expanded hole section 18 disposed so as to face the aperture 14. A terraced level between the larger-diameter hole section 15 and the middle-diameter hole section 16 serves as a valve seat 19.

As shown in FIGS. 2 and 3, a gas vent valve 20 is inserted into the valve guide 13 and comprises a valve shaft 21 and a valve section 22 disposed at a top side (the left-hand side in FIG. 3) of the shaft 21. The valve shaft 21 is slidably fit in the smaller-diameter hole section 17 and the valve section 22 is slidably fit in the larger-diameter hole section 15, whereby the valve guide 13 is arranged so as for a rear portion 22*a* of its valve section 22 to be seated on or depart from the valve seat 19 in association with a sliding movement of the valve shaft 21. In other words, the valve seat 19 and the rear portion 22*a* of the valve guide 13 serve as an opening-closing section for the gas vent passage 10. As shown in FIG. 3, a peripheral groove 23 is formed on the outer periphery of the valve shaft 21. Between the peripheral groove 23 and the valve guide 13 is provided a lock ball 24 which in turn is urged by a first spring 25 toward the valve shaft 21 in its radial direction and which further is arranged so as to be kept in the peripheral groove 23 as long as no force is applied to the valve shaft 21 in its axial direction to such an extent that the valve guide 13 is pushed toward the rightward direction in FIG. 3 and that the lock ball 24 is caused to roll over a peripheral side wall of the peripheral groove 23 and reside on the outer periphery of the valve shaft 21 in resistance to the force urged by the first spring 25.

On the outer periphery of the valve shaft 21 on its rear end side (on the right-hand end side in FIG. 3) is fitted on a piston 27 which in turn is slidably inserted so as to fit in the expanded hole section 18 of the valve guide 13. Between the piston 27 and the valve guide 13 is mounted a second spring 28 which in turn urges the piston 27 toward the direction in which the rear portion 22*a* of the valve section 22 is seated on the seat valve 19 so as to close the valve. The force urged by the second spring 28 upon the piston 27 is set to such an extent that the lock ball 24 is not caused to roll over the peripheral side wall of the peripheral groove 23 and reside on the outer periphery of the valve shaft 21 in resistance to the force urged by the first spring 25. Thus, the lock ball 24 is kept fitted in the peripheral groove 23 of the valve shaft 21 due to the peripheral side wall of the peripheral groove 23, whereby the valve section 22 of the valve shaft 21 is retained in ordinary conditions in such a state that it is apart from the valve seat 19 so as to open the valve, as shown in FIG. 3.

Figure 5:
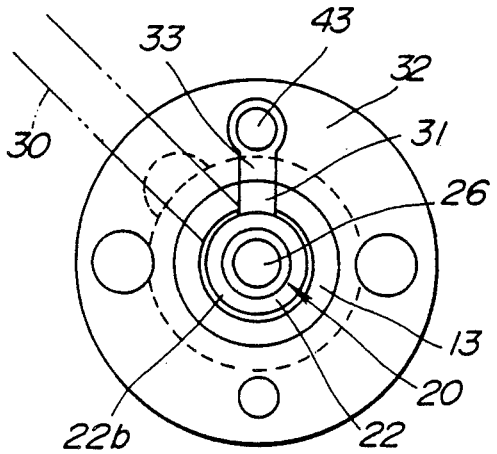
FIG. 5 is a view showing a movable mold half with its essential portion enlarged, which corresponds to FIG. 4.

Turning to FIG. 5, the valve section 22 is provided on its top side face 22*b* with a concave portion 26 which is in a circular shape coaxial with the valve shaft 21 and which is tapered inwardly.

Referring back to FIG. 3, a peripheral space 29 is disposed between the valve shaft 21 and the middle-diameter hole section 16 of the valve guide 13 and communicated with a passageway 30 through which gas or the like is discharged from the space toward the outside by means of vacuum suction.

As shown again in FIG. 3, a cut-out groove 31 is formed on the larger-diameter hole section 15 of the valve guide 13 in the position located above the valve section of the gas vent valve 20 and disposed closer to the top side of the valve guide 13 than the valve seat 19. On the valve guide 13 is fitted a ring-like third insert 32 on the outer periphery side of the cut-out groove 31, and the third insert 32 is further fitted in the first insert 5, whereby the end face of the third insert 32 constitutes parts of the end surface of the valve guide 13 and the mating face 6. The third insert 32 is provided with a vertical groove 33 which is communicated with the cut-out groove 31 and which opens from an end face of the third insert 32 to face the second insert 7. The vertical groove 33, the cut-out groove 31 and the ring-like space 29 constitute the second passage section 12 of the gas vent passageway 10.

As shown in FIGS. 2 and 3, a fourth insert 34 is formed in the second insert 7 so as to correspond to the third insert 32 and an end face of the fourth insert 34 constitutes part of the mating face 8. The fourth insert 34 is provided with a projection 35 which may be terraced or tapered. Thus a base portion of the projection 35 constitutes a larger-diameter section 35*a* and a top portion thereof constitutes a smaller-diameter section 35*b* while a terraced level 35*c* is formed between the larger-diameter section 35*a* and the smaller-diameter section 35*b*The projection 35 is further arranged such that, when the movable mold half 2 is fastened to the fixed mold half 3, the smaller-diameter section 35*b* is fitted tightly in the concave portion 26 of the gas vent valve 20 and the larger-diameter section 35*a* is fitted tightly with the larger-diameter section 15 of the valve guide 13, while the terraced level 35*c* comes into abutment with the end face 22*b* surrounding the concave portion 26 of the gas vent valve 20. In this state, it can be noted that there is disposed a clearance between the projection 35 (more specifically, the smaller-diameter 35*b*) and the concave portion 26, thereby resulting in a space 36.

The first passage section 11 in the gas vent passage 10 is disposed along the side and end surfaces of the projection 35 so as to face the mating face 6.

Figure 4:
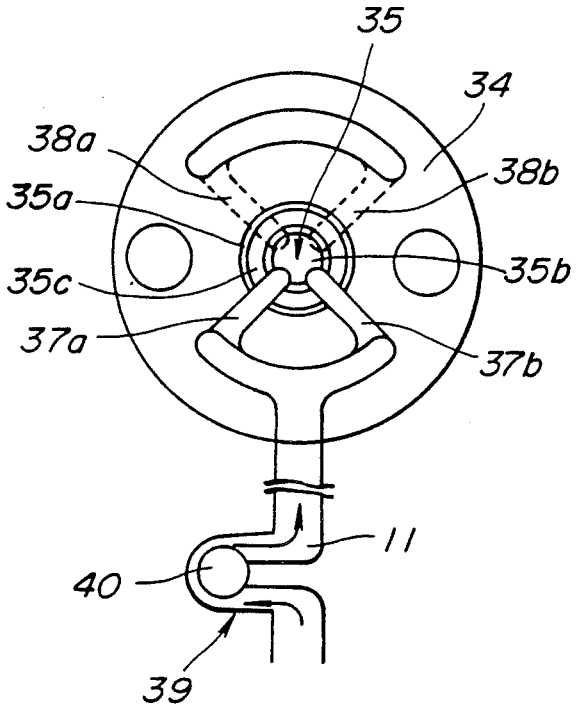
FIG. 4 is a view with its essential portion enlarged in FIG. 1.

More specifically, in the embodiment as shown in FIG. 4, the first passage section 11 extending from the side of the mold cavity 9 to the space 36, or a gas-introducing passageway for introducing gases to the space 36, on the one hand, is branched into first branch passage sections 37*a* and 37*b* so as to be disposed symmetrically in upward directions on a peripheral side wall of the projection 35. The first passage section 11 extending from the space 36 to the second passage section 12, or a gas-discharging passageway for discharging the gases from the space 36, on the other hand, comprises second branch passage sections 38*a* and 38*b*, which are disposed symmetrically in upward directions in the projection area where the passage section 11 is located, so as to extend within the projection 35 in its vertical directions as hollow passageways in the area where the first passage section 11 is located, and which are then communicated with the vertical groove 33. It is to be noted herein that the total sectional area of the first branch passage sections 37*a* and 37*b* is set so as to be substantially equal to that of the second branch passage sections 38*a* and 38*b*, thereby permitting a smooth passage of the gases through the branch passage sections 37 and 38.

In this embodiment as shown in FIG. 4, the first passage section 11 is provided with a curved section 39 on the upstream side of the end portion 22*b* and the rear portion 22*a* of the gas vent valve 20 as well as the valve seat 19. On the curved section 39 is disposed a coolant tube 40 so as to be exposed locally to the first passage section 11. As a coolant may be used water, for example, having temperature of 18°]C., pressure of 4 kg/sq. mm, and a water-inlet diameter of 10 mm. The arrows in FIG. 3 denote the direction of a liquid flow.

As shown in FIG. 2, an ejector box 41 is mounted to the movable mold half 2 and an ejector plate 42 is disposed in the ejector box 41 so as to be driven by a cylinder (not shown) in the transverse direction in the drawing. To the ejector plate 42 are mounted a plurality of ejector pins 43 tops of which face the vertical groove 33, the first passage section 11 and so on. A push rod 44 is slidably supported by the ejector plate 42 in such a manner that one end portion of the push rod 44 is inserted in the aperture 14 as a push section 46 and the other end portion thereof is fixed by a nut 47 on the outer side of the ejector plate 42. On the other periphery of the push rod 44 is fitted a third spring 48 having urging force stronger than that of the second spring 28, thereby urging the push section 46 of the push rod 44 so as to be apart from the ejector plate 42. With this arrangement, when the mold is being opened, the push rod 44 presses the gas vent valve 20, thereby providing the gas vent valve 20 with the function of pushing a burr of the molded article, like the ejector pins 20.

When the movable mold 2 is unfastened from the fixed mold half 3, the ejector plate 42 is fixed in the position as shown in FIG. 2 until the movable mold half 2 is apart from the fixed mold half 3 in a given distance. As the movable mold half 2 is apart from the fixed mold half 3 in the given distance, the ejector plate 42 is moved in association with the movable mold half 2 while leaving the ejector pins 43 in such a state that they project toward the fixed mold half 3 from the movable mold half 2 and allowing the ejector pins to push a molded article out from the mold. The push rod 44 presses the gas vent valve 20 toward the leftward direction in FIG. 2, whereby the gas vent valve 20 becomes in such a state as projecting from the movable mold half 2 toward the fixed mold half 3, thereby fulfilling the function of pushing the molded article out of the mold, like the ejector pins 43.

The push rod 44 also serves as part of an operation-failure detecting means for detecting a failure of operation of the gas vent valve 20. More specifically, a limit switch 51 is mounted through a bracket 50 on a plate surface on the outer side of the ejector plate 42 so as to face the other end face of the push rod 44. This arrangement causes the push rod 44 to move in the rightward direction to an excessive extent with respect to the ejector plate 42 when the gas vent valve 20 is fixed in the state as shown in FIG. 2 upon unfastening the mold, so that this state can be sensed by the limit switch 51. It can be noted as a matter of course that, when the gas vent valve 20 is fixed in that state, the valve 20 cannot fulfill the function of pushing the molded article out of the mold.

Referring to FIG. 2, reference numeral 52 denotes an inlet for pouring a molten material. As shown in FIG. 3, reference numeral 53 stands for an air supply pipe and 54 for a thermal insulating material.

Referring further to FIG. 2, a pressure is applied to force the molten material to be poured into the mold cavity 9 from the inlet 49 by means of a plunger, and any gases in the mold cavity 9 are allowed to escape through the first passage section 11 and the second passage section 12 of the gas vent passageway toward the outside, as indicated by the arrows in FIG. 3. Then the molten material acts upon the concave portion 26 on the valve section 22 of the gas vent valve 20, thereby pushing the gas vent valve 20 to the rightward direction in the drawing. As the force of the molten material acting upon the valve section 22 exceeds the force urged by the first spring 25 to thereby force the lock ball 24 to roll over the peripheral groove 23 and locate on the outer periphery of the valve shaft 21 and, at the same time, allow the valve section 22 to be seated on the valve seat 19. In this instance, the gas vent valve 20 starts departing from the terraced portion 35*c* of the projection 35. For a time period until the gas vent valve 20 is fully closed, the gases can be led to the outside through a gap disposed between the gas vent valve 20 and the terraced portion 35*c* of the projection 35.

On the other hand, a flow of the molten material forced into the first passage section 11 up to the facing side wall of the projection 35 is changed so as to follow along the side wall thereof and direct toward the end portion of the valve section 22 of the gas vent valve 20, thereby acting upon the concave portion 26 effectively and enhancing a sensitivity of the gas vent valve 20. This arrangement permits an ensured seating of the valve section 22 of the gas vent valve 20 on the valve seat 19 until the molten material reaches the valve seat 19, thereby improving accuracy of the timing at which the gas vent valve 20 is closed.

The fitting of the projection 35 with the concave portion 26 provides the space 36 which, in turn, is communicated only with the first branch passage sections 37*a*, 37*b* and the second branch passage sections 38*a*, 38*b*, so that a peripheral portion of the end surface 22*b* of the valve section 22 is rendered smaller to the largest possible extent in area that is exposed to the first passage section 11. Thus, the molten material is prevented from leaking into the space 29 as much as possible through the mating surfaces between the peripheral portion of the valve section 22 and the larger-diameter section 15.

It is further to be noted that the projection 35 enables the molten material to be led through the first branch passage sections 37*a* and 37*b*, disposed thereon in a symmetrical manner, to the concave portion 26 of the gas vent valve 20. This can block the pressure of the molten material from applying to the end surface 22*b* of the valve section 22 of the gas vent valve 20 in an uneven or localized state and permit a smooth operation of the gas vent valve 20.

As the molten material is forced to pour into the mold cavity 9, gases and fine particles thereof precede a flow of the molten material through the first passage section 11. The fine particles are caused to collide with the curved section 39, thereby reducing their flowing velocity as well as being coagulated upon a direct contact with the coolant tube 40. This improves coagulation and collection of the fine particles to a significant extent.

By coagulating the fine particles in the molten material with the coolant tube 40 at the curved section 39 of the first passage section 11, they are prevented from adhering to the valve seat 19 and the rear portion 22*a* of the valve section 22 of the air vent valve 20 as well as to an area ranging from the peripheral portion of the end surface 22*b* of the valve section 22 to the larger-diameter 15 of the valve guide 13. Thus, a failure of operation of the gas vent valve 20 can be prevented all the more, in association with a reduced area of the peripheral portion of the end surface 22*b* of the valve section 22 in exposure to the first passage section 11 as described hereinabove. As a result, a leakage of the molten material arising from such a failure of operation can be prevented in a more ensured way.

An improved collection of the fine particles of the molten material through coagulation may omit cooling operation which may impair a flow of the molten material, thereby ensuring a flowability of the molten material as well as attaining a desired extent of coagulating and collecting the fine particles thereof. By ensuring the flowability of the molten material, a sensitivity of the gas vent valve 20 is improved to thereby prevent a leakage of the molten material. On top of that, a failure of operation the gas vent valve 20 arising from the fine particles of the molten material adhering to the valve seat 19, the valve section 22 and so on can also be prevented resulting in a prevention of a leakage of the molten material to a significant extent, particularly at the time of breathing the mold. The fine particles collected by coagulation are then moten by the flow of the molten material that flows thereafter, so that they do not impede the flow of the molten material.

Figure 6:
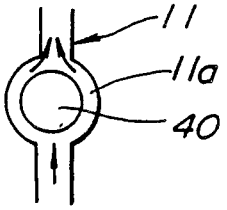
FIG. 6 is a view for explanation of another example.

FIG. 6 shows another example illustrating a portion of the first passage section 11 corresponding to the curved portion 39 in the previous embodiment. In this embodiment, the first passage section 11 is provided with an enlarged section 11*a* where the coolant tube 40 is disposed so as to allow its outer periphery to face a flow of the molten material and to allow gases, fine particles thereof and so on to flow on the both sides of the tube 40 and then reach the gas vent valve 20. This arrangement may reduce the flow of the gases and fine particles by means of a buffer action of the coolant tube 40 and improve all the more coagulation of the fine particles upon direct collision with the tube 40.

What is claimed is;

1. A gas vent system of a mold, comprising:

a gas vent passageway formed on mating surfaces of a pair of mold halves and communicating a mold cavity with the outside of a mold when the mold is closed; and a gas vent valve mounted on one of the mold halves and disposed intersecting in a direction substantially perpendicular to the gas vent passageway so as to block the gas vent passageway in response to a pressure from a molten material forced into the mold cavity;

wherein the gas vent valve is provide don its end surface receiving the pressure from the molten material with a concave portion opening toward the other of the mold halves;

a projection is formed on the other of the mold halves and disposed so as to be fitted tightly in the concave portion of the gas vent valve when the mold is fastened; and the projection is provided with part of the gas vent passageway, which is directed toward the concave portion of the gas vent valve so as to pass gases therethrough from the mold cavity to the concave portion of the gas vent valve.

2. A gas vent system as claimed in claim 1, wherein:

the gas vent valve comprises a valve section whose rear portion opposite to the end surface receiving the pressure from the molten material is formed in a state that the rear portion is seated on or departed from a valve seat to thereby close or open the gas vent passageway which is communicated with the outside through the rear portion of the gas vent passageway when the gas vent valve is open.

3. A gas vent system as claimed in claim 2, wherein:

a clearance is provided between the projection and the concave portion when the projection si fitted tightly in the concave portion; and a space formed by the clearance between the projection and the concave portion is communicated with the gas vent passageway.

4. A gas vent system as claimed in claim 3, wherein:

the part of the gas vent passageway mounted on the projection comprises a groove formed on its side surface; and at least two of grooves are disposed substantially symmetrically in a longitudinal direction to each other.

5. A gas vent system as claimed in claim 4, wherein:

the projection is in such a shape that a larger-diameter section is located at its base portion and a smaller-diameter section is located at its top portion with a terraced level disposed therebetween;

wherein the smaller-diameter section of the projection is arranged to be fitted tightly in the concave portion of the gas vent valve; and the terrace level is abutted with a peripheral side surface surrounding the concave portion of the gas vent valve.

6. A gas vent system as claimed in claim 5, wherein:

the smaller-diameter section of the projection is tapered in such a manner that its diameter is reduced gradually as it comes to its end portion, while the concave portion of the gas vent valve is shaped in such a manner that its diameter is enlarged gradually as it comes to its opening end portion so as to fit the smaller-diameter section therein.

7. A gas vent system as claimed in claim 6, wherein the gas vent passageway is provided with a coolant tube between the mold cavity and the gas vent valve.

8. A gas vent system as claimed in claim 7, wherein the gas vent passageway is provided with a curved section curved and reversed at approximately 180 degrees and the coolant tube is disposed in the curved section.

9. A gas vent system as claimed in claim 7, wherein the gas vent passageway is provided with an enlarged section in which an effective sectional area is enlarged, and the coolant tube is disposed in a central portion of the enlarged section.

10. A gas vent system as claimed in claim 1, wherein:

the smaller-diameter section of the projection is tapered in such a manner that its diameter is reduced gradually as it comes to its end portion, while the concave portion of the gas vent valve is shaped in such a manner that is diameter is enlarged gradually as it comes to its opening end portion so as to fit the smaller-diameter section therein.

11. A gas vent system as claimed in claim 1, wherein the gas vent passageway is provided with a coolant tube between the mold cavity and the gas vent valve.

12. A gas vent system as claimed in claim 11, wherein the gas vent passageway is provided with a curved section curved and reversed at approximately 180 and the coolant tube is disposed in the curved section.

13. A gas vent system as claimed in claim 11, wherein the gas vent passageway is provided with an enlarged section in which an effective sectional area is enlarged, and the coolant tube is disposed in a central portion of the enlarged section.

14. A gas vent system as claimed in claim 1, wherein:

a plurality of push rods are disposed coaxially with a valve shaft of the gas vent valve so as to face an end surface opposite to a valve section of the gas vent valve; and one of the push rods is arranged to push the gas vent valve when one of the mold is opened to thereby provide the gas vent valve with function of pushing a molded product.

15. A gas vent system as claimed in claim 14, wherein:

said one of the push rods is mounted to an ejector plate; and an ejector pin is fixed to the ejector plate.

16. A gas vent system as claimed in claim 15, wherein:

said one of the push rods is disposed so as to penetrate through the ejector plate; and a spring is disposed between said one of the push rods and the ejector plate so as to urge said one of the push rods to push the gas vent valve.

17. A gas vent system as claimed in claim 16, wherein:

the ejector plate is provided with a limit switch so as to face an end surface of said one of the push rods opposite to the end surface facing the gas vent valve; and the limit switch is to detect whether the gas vent valve is fixed.

* * * * *